US008074478B1

(12) United States Patent
Shu

(10) Patent No.: US 8,074,478 B1
(45) Date of Patent: Dec. 13, 2011

(54) HORIZONTAL LOCKING CASE LOCK

(75) Inventor: Chang Chin Shu, Changhua (TW)

(73) Assignee: Vulcan Sports Co., Ltd., Changhua (TW)

( * ) Notice: Subject to any disclaimer, the term of this patent is extended or adjusted under 35 U.S.C. 154(b) by 0 days.

(21) Appl. No.: 12/805,318

(22) Filed: Jul. 26, 2010

(51) Int. Cl.
*E05B 69/00* (2006.01)
*E05B 73/00* (2006.01)

(52) U.S. Cl. ..... 70/58; 70/386; 70/68; 70/14; 70/18; 70/232; 70/312; 70/30; 70/DIG. 57

(58) Field of Classification Search ..... 70/386, 70/68, 14, 18, 58, 232, 312, 30, DIG. 57
See application file for complete search history.

(56) References Cited

U.S. PATENT DOCUMENTS

| | | | | |
|---|---|---|---|---|
| 4,677,834 | A * | 7/1987 | Hicks | 70/279.1 |
| 4,951,485 | A * | 8/1990 | Wake | 70/68 |
| 6,796,152 | B1 * | 9/2004 | Yu | 70/58 |
| 2004/0093916 | A1 * | 5/2004 | Ling | 70/58 |
| 2006/0254329 | A1 * | 11/2006 | Yu | 70/284 |
| 2008/0236212 | A1 * | 10/2008 | Ma | 70/77 |

* cited by examiner

*Primary Examiner* — Lloyd Gall
*Assistant Examiner* — David E Sosnowski
(74) *Attorney, Agent, or Firm* — Guice Patents PLLC

(57) ABSTRACT

A horizontal locking case lock includes a coupler fastened to a case and a lock with a housing surface latchable horizontally by the coupler for locking. The coupler includes at least a first wedge portion and at least one latch trough. The lock contains a locking mechanism. The locking mechanism drives and controls movement of a first retainer to further drive a second retainer to force a steel ball into or out of the latch trough, thereby control locking or unlocking of the coupler and the lock. Such a structure can safely lock the case at a public location to avert hitting and pilferage.

7 Claims, 10 Drawing Sheets

HORIZONTAL LOCKING CASE LOCK

BACKGROUND OF THE INVENTION

1. Field of the Invention

The present invention relates to a horizontal locking case lock and particularly to a case lock adaptable for locking a case such as a tool kit, repairs box, luggage or the like at a public location to avert hitting and pilferage.

2. Description of the Prior Art

Conventional took kits, repairs boxes, travel luggage often are being moved and held at public locations. While some of those cases have a built-in lock to prevent unauthorized opening, they still have other issues remained to be overcome. And the owners of the cases do not always staying nearby to watch out. For instance, repairs and maintenance people often leave their tool kits at one spot while carrying needed tools to a remote location to do repairs and maintenance work. The tool kits remained behind could easily be taken away by some other people. Another instance often happens to travelers who leave their luggage at the waiting room or station concourse while going to lavatory. If the luggage is not being fastened to a certain fixed object (such as a chair), it is easily stolen.

Please refer to FIG. 1 for a conventional simple lock 81 which is usually inserted vertically into a latch bore 821 of a shell 82, or FIG. 2, with a padlock 91 latching the junction of two zipper heads 93 of a luggage 92. Either way has the lock conspicuously jutting outside the locking object (such as the shell 82, luggage 92 or the like). The latch bore 821 (or zipper heads 93) is easily skewed and deformed, or damaged by twisting and results in difficulty in opening. All this creates a lot of troubles for users.

SUMMARY OF THE INVENTION

In view of the aforesaid problems, the present invention aims to provide a horizontal locking case lock to safely lock a case at a public location to avert hitting and pilferage.

To achieve the foregoing object the invention includes a coupler fastened to a shell and a lock with a housing surface latchable horizontally by the coupler. The coupler includes at least a first wedge portion and at least a latch trough. The lock contains a locking mechanism. The locking mechanism drives and controls movement of a first retainer to further drive a second retainer to force a steel ball into or out of the latch trough, thereby control locking or unlocking of the coupler and the lock. As a result, it can avert hitting and pilferage.

The intended locking shell is a luggage, a tool kit, a repairs box or other lockable object.

The coupler of the invention further includes an anchor head and a bolt.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 2:
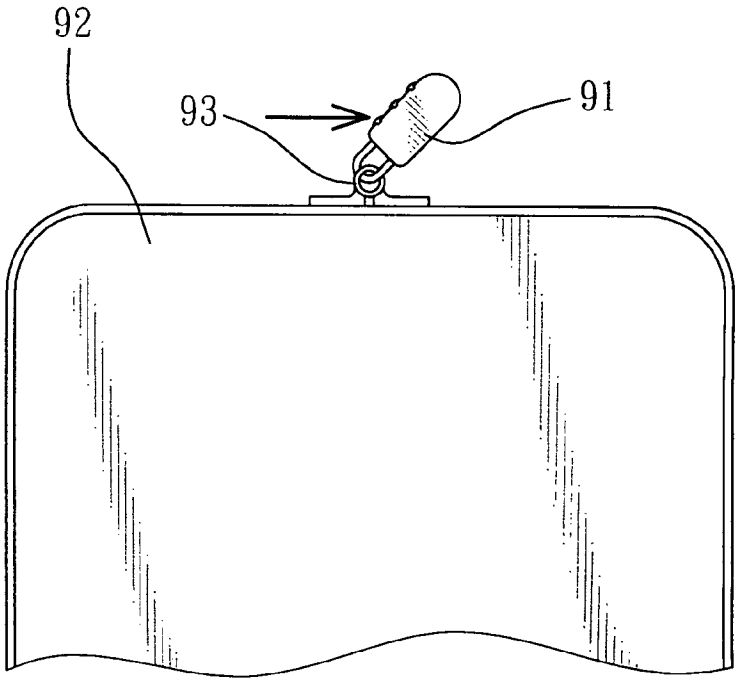
FIG. 2 PRIOR ART
FIG. 2 is a schematic view of another conventional embodiment.
Figure 1:
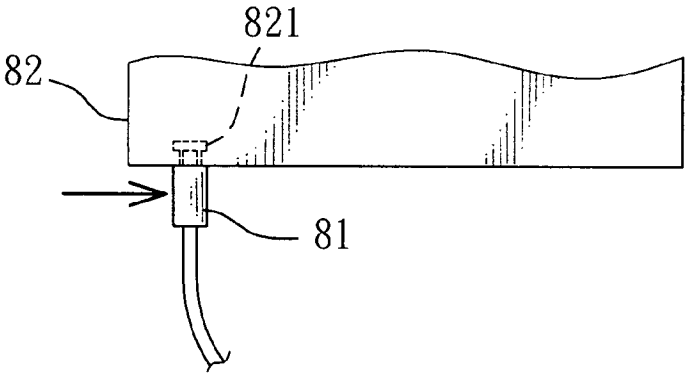
FIG. 1 PRIOR ART
FIG. 1 is a schematic view of a conventional embodiment.
Figure 3:
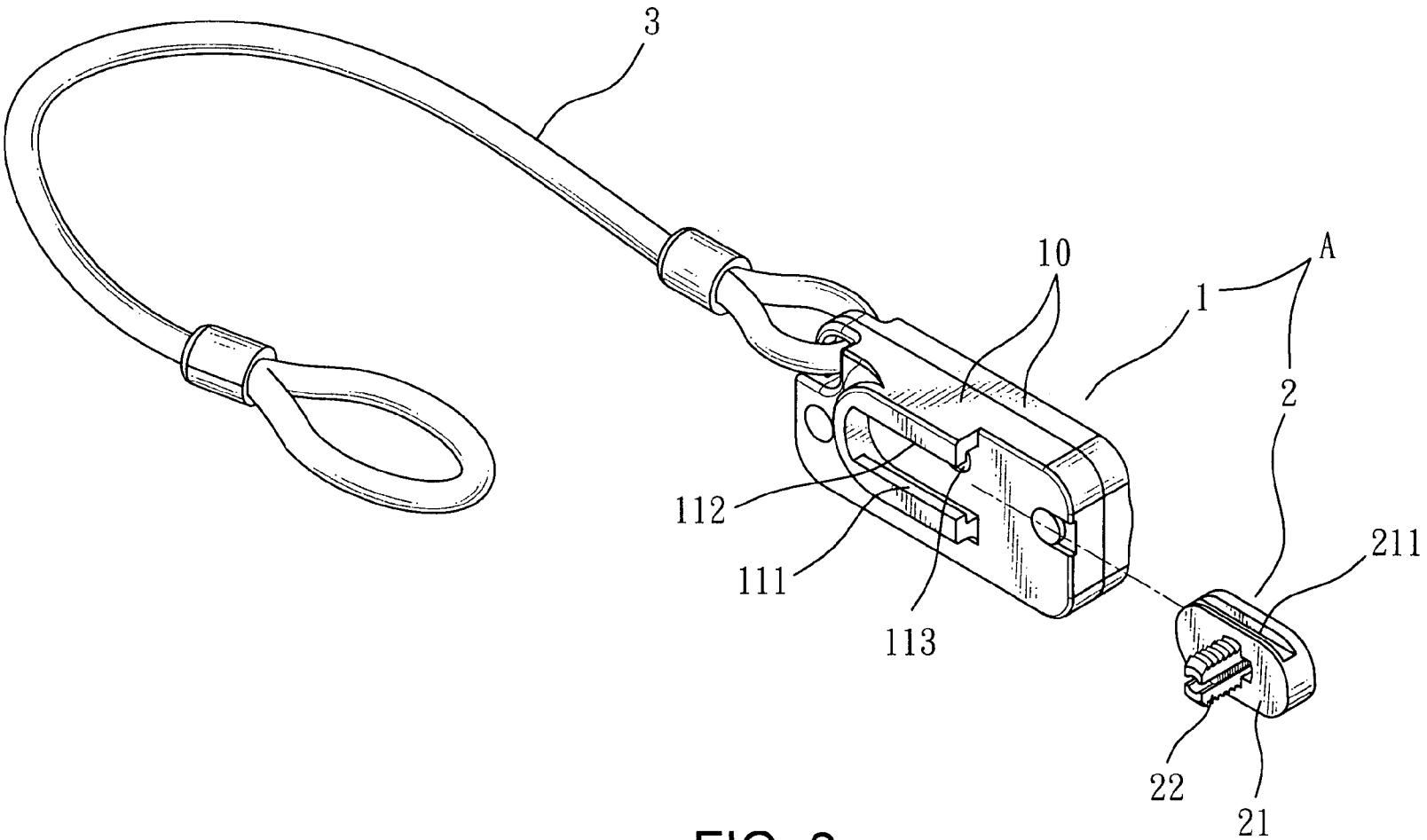
FIG. 3 is a perspective view of the invention.
Figure 4:
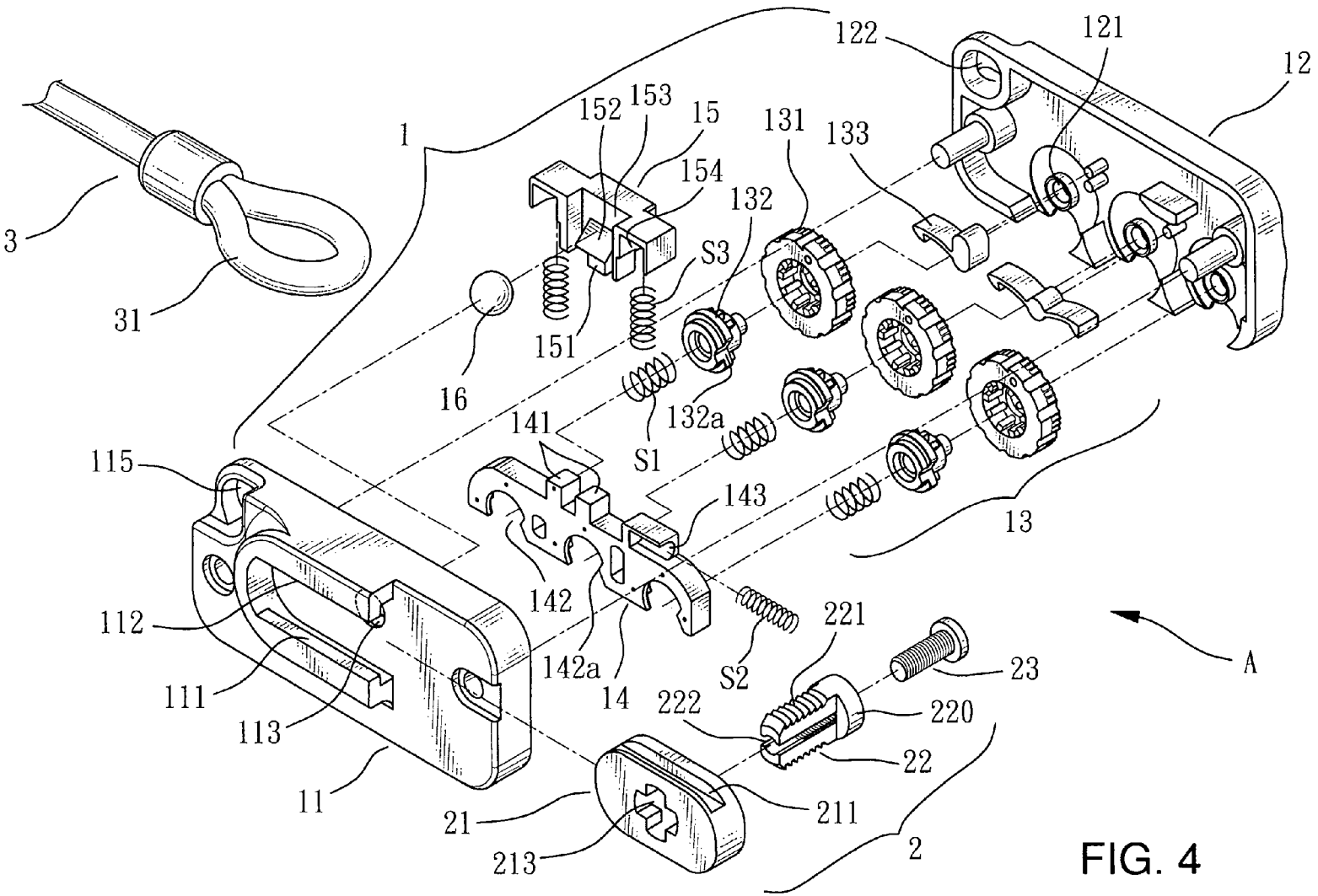
FIG. 4 is an exploded view of the invention.
Figure 5:
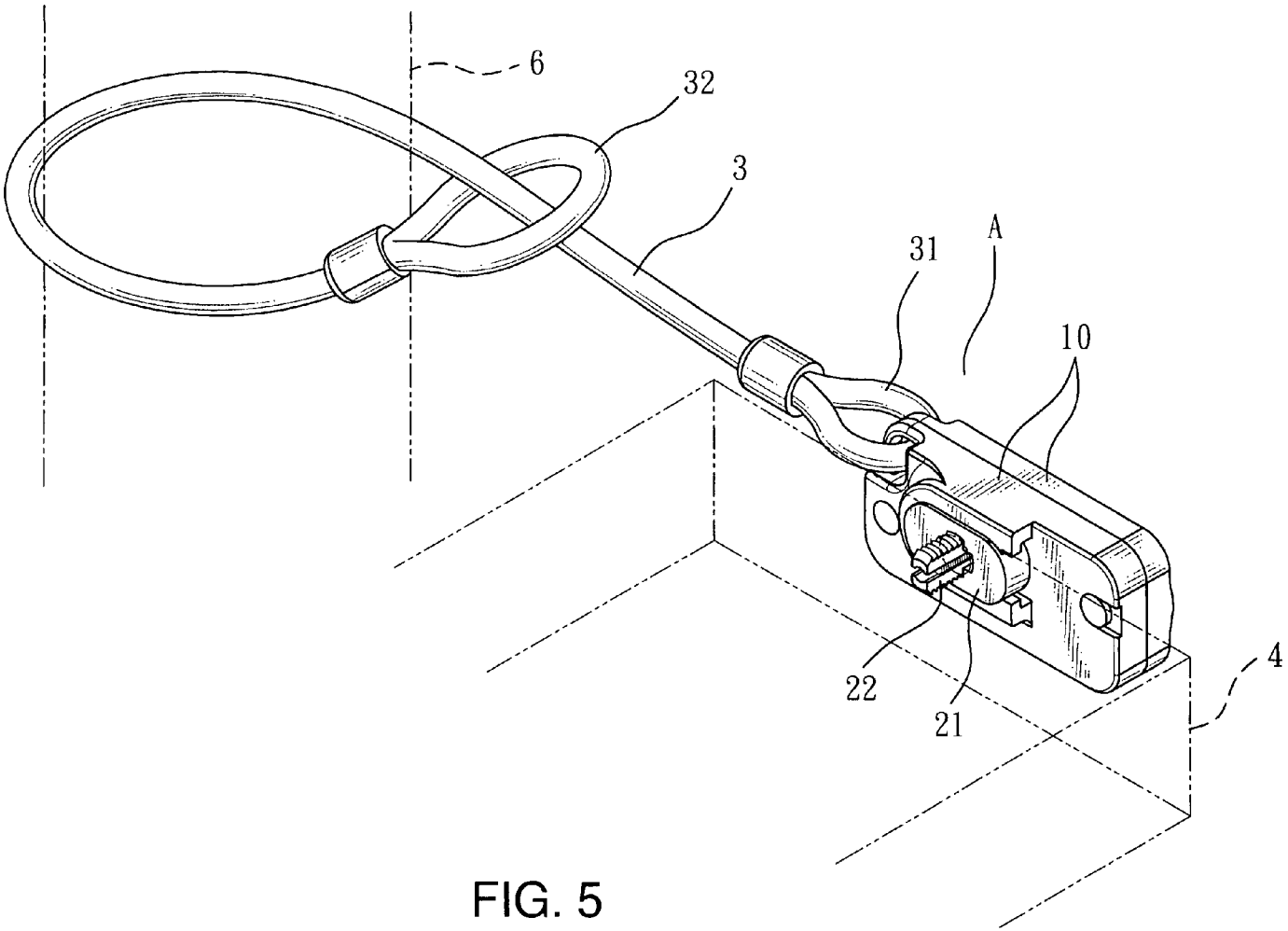
FIG. 5 is a schematic view of an embodiment of the invention.

Please referring to FIGS. 3, 4 and 5. the present invention provides a case lock A which includes a coupler 2 fastened to a shell 4 (also referring to FIG. 9) and a lock 1 with a housing surface allowing the coupler 2 to wedge and latch thereon horizontally.

Figure 7:
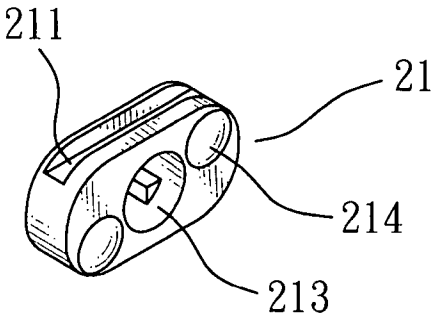
FIG. 7 is a perspective view of the coupler of the invention.

The coupler 2 has a body 21 which has at least a first wedge portion 211 and 212 at one edge and a latch trough 214 and a coupling hole 213 at one side (referring to FIG. 7). The coupling hole 213 receives insertion of an anchor head 22. The anchor head 22 has a stem 221 at one side with a plurality of inclined teeth 221*a* formed on the surface thereof. The anchor head 22 has a head end 220 at another side. The head end 220 has a longitudinal hole 222 running through the center thereof to divide the stem 221 into at least two portions. The longitudinal hole 222 has an internal thread section 222*a* near the head end 222 to fasten a bolt 23 to expand the stem 221 outwards (also referring to FIG. 10) to be anchored on a latch hole 41 on the shell 4.

Figure 8:
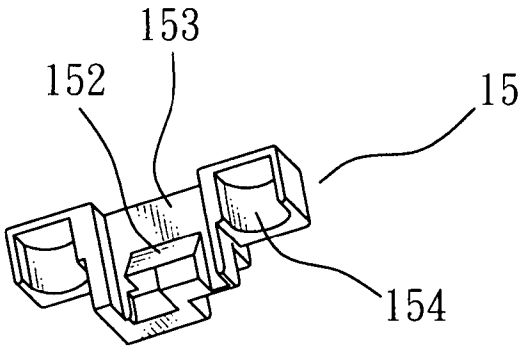
FIG. 8 is a perspective view of the second retainer of the invention.

The lock 1 has a housing 10 consisting of a left housing 11 and a right housing 12 coupled together. The housing 10 has second wedge portions 111 and 112 on the surface that are latchable by the first wedge portions 211 and 212 for locking. The housing 10 also contains a locking mechanism 13, a first retainer 14, a second retainer 15 and a steel ball 16. The locking mechanism 13 can be locked and unlocked to drive at least one boss 141 formed on the top of the first retainer 14 to latch a butting member 151 located at the bottom of the second retainer 15. The butting member 151 has a sloped surface 152 and a holding trough 153 on a upper side (referring to FIG. 8) to receive or push the steel ball 16 inside or outwards a steel ball passing hole 113 formed on the housing 10 to be latched in latch trough 214 of the coupler 2 to actuate locking of the coupler 2 and the lock 1.

Figure 6:
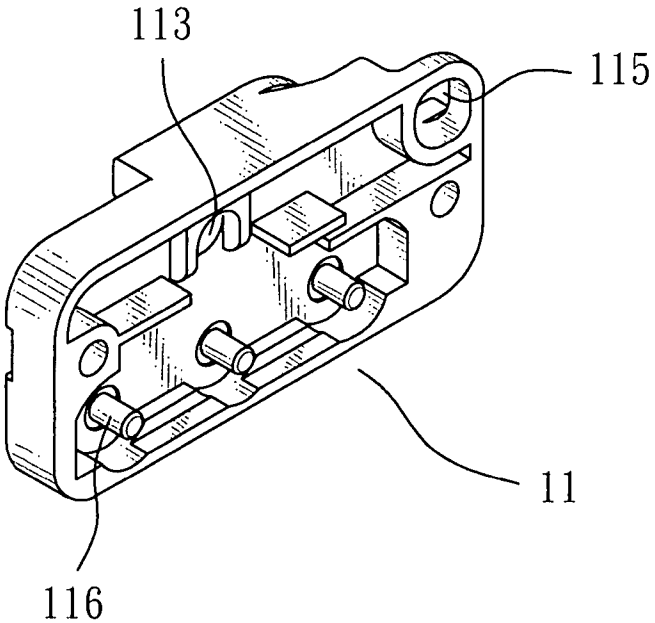
FIG. 6 is a perspective view of the left housing of the invention.

The locking mechanism 13 includes at least a rotary disk 131 which holds an actuation member 132 and a first spring S1, and is installed between a fastening strut 116 of the left housing 11 and an axle holder 121 of the right housing 12 (also referring to FIG. 6). The rotary disk 131 is selectively positioned in stages by a poking arm 133 to facilitate turning thereof according to a selected number. The structure of the locking mechanism 13 is known in the conventional combination lock and forms no part of the invention, thus details are omitted herein.

The first retainer 14, in addition to having at least one boss 141 on the top, also includes a first spring housing trough 143 at one side to hold a second spring S2 which provides an elastic force to move the first retainer 14 and a semicircular hole 142 at the bottom to hold the actuation member 132. The semicircular hole 142 has a flange 142*a* on the circumference to latch in a notch 132*a* formed on the actuation member 132 to move the first retainer 14.

The butting member 151 of the second retainer 15 has a second spring housing trough 154 on each of two sides thereof to hold respectively a third spring S3.

The housing 10 further has apertures 115 and 122 threaded through by a first ring 31 of a rope 3. The rope 3 provides extension to facilitate locking of the lock 1 on the shell 4. As shown in FIG. 5, the rope 3 can surround a fixed object 6 (such as a table, chair, wall pillar) and with a second ring 32 of the rope 3 threading through the lock 1 to finish locking operation.

Figure 10:
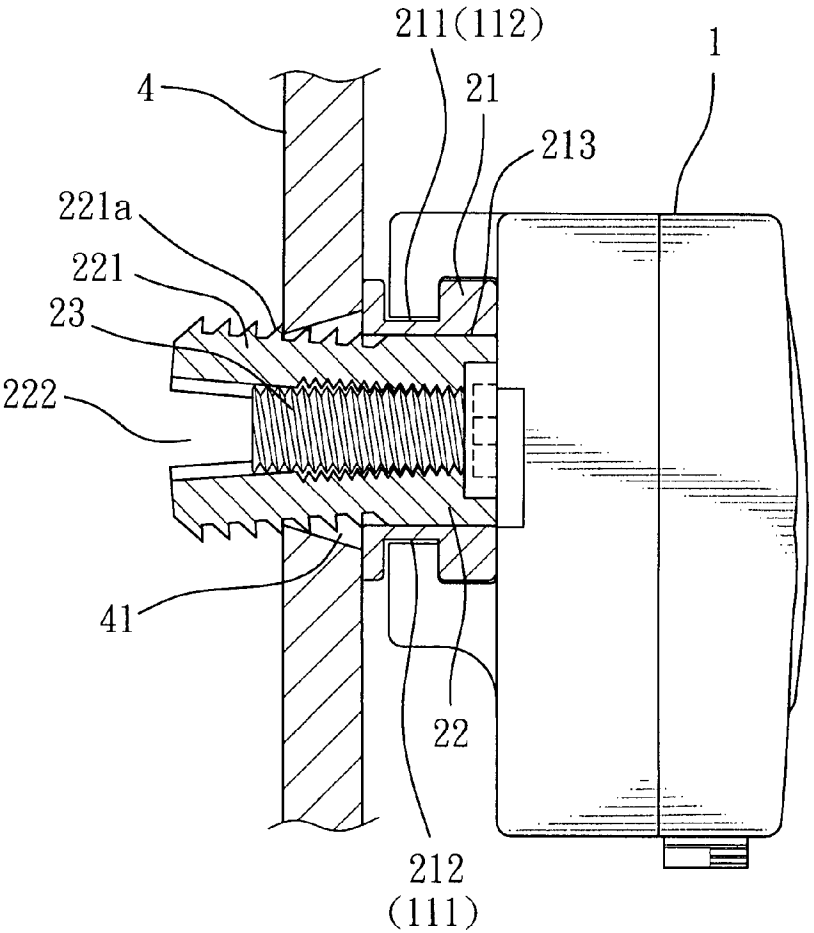
FIG. 10 is a schematic view of the invention showing operation condition-2 of the coupler engaging with the shell.
Figure 9:
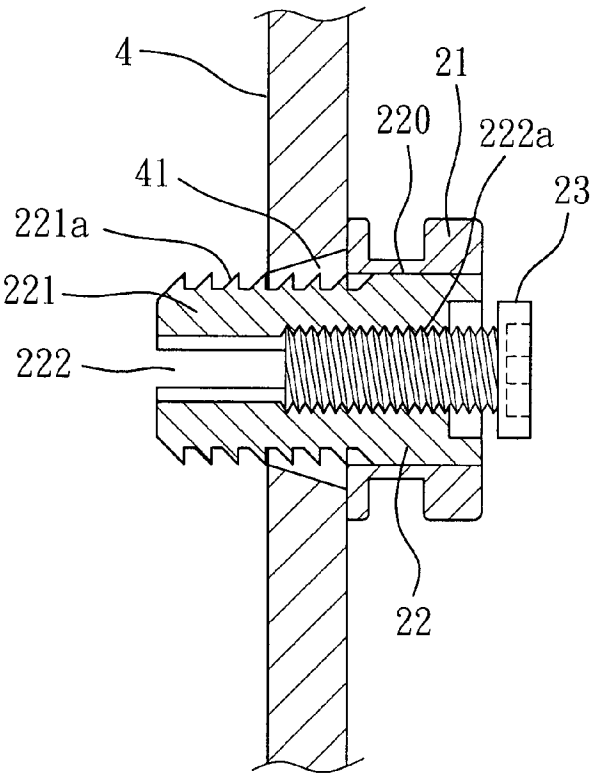
FIG. 9 is a schematic view of the invention showing operation condition-1 of the coupler engaging with the shell.
Figure 12:
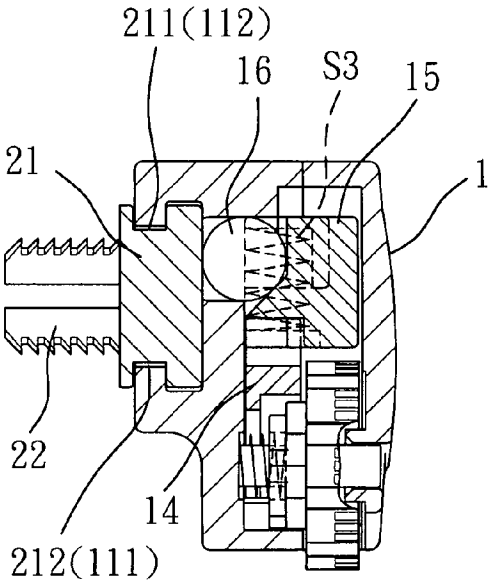
FIG. 12 is a cross section taken on line I-I in FIG. 11.
Figure 11:
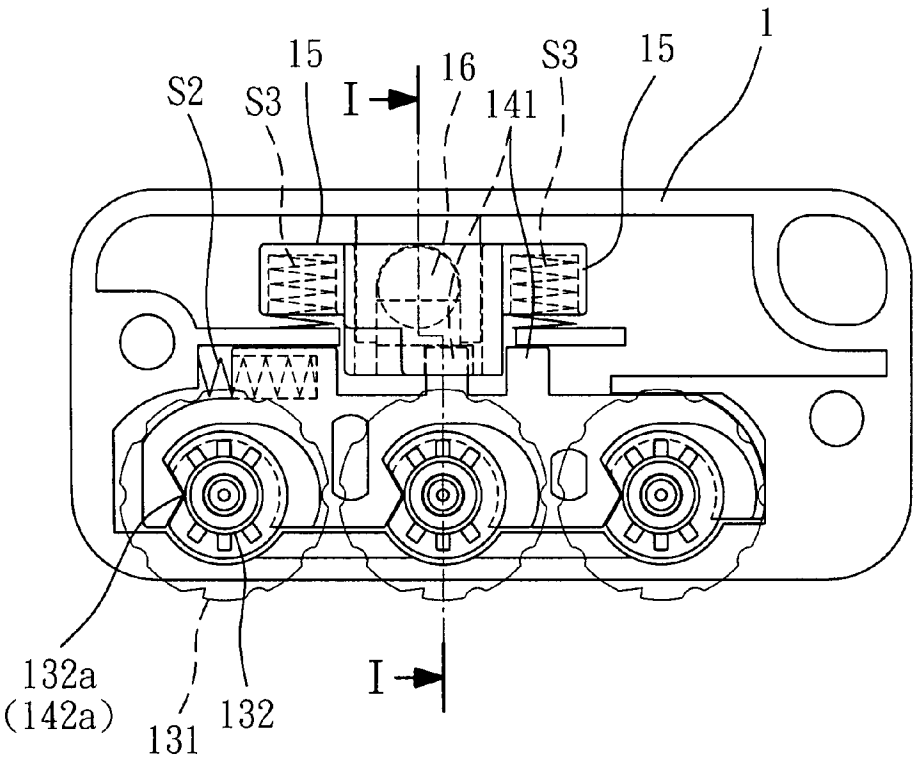
FIG. 11 is a schematic view of the invention in an unlocking condition.
Figure 14:
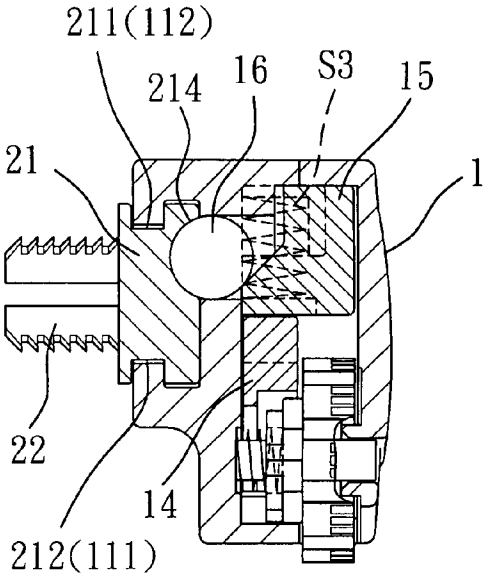
FIG. 14 is a cross section taken on line II-II in FIG. 13.
Figure 13:
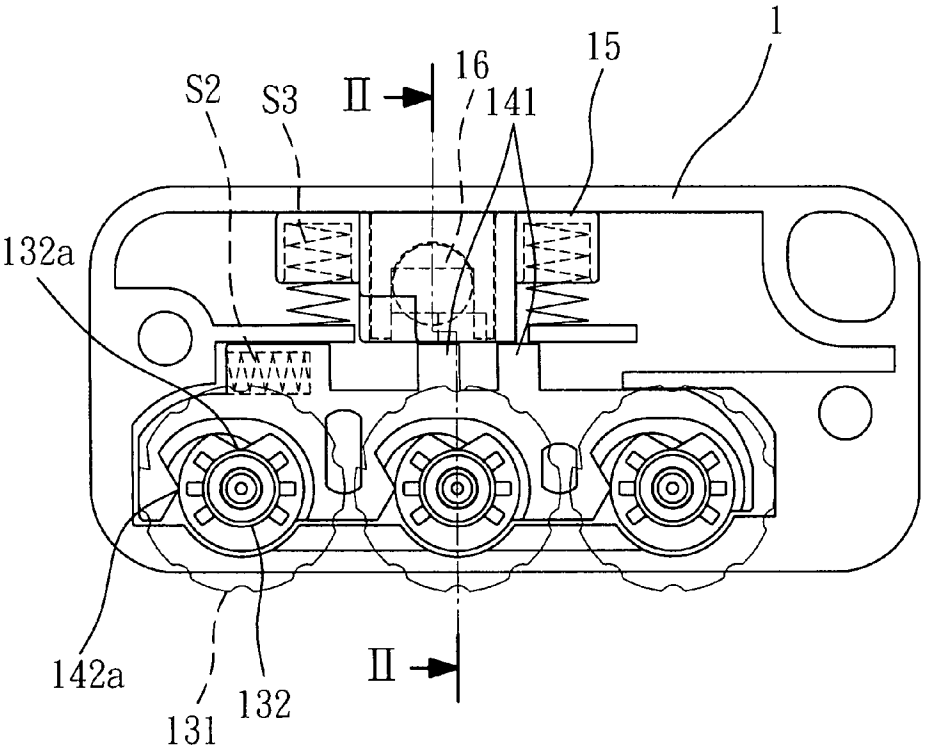
FIG. 13 is a schematic view of the invention in a locking condition.

The shell 4 can be a luggage, a tool kit or a repairs box or other lockable article. The locking mechanism 13 is not limited to the combination lock. All other known locking means can be adopted as desired. Referring to FIGS. 9 and 10, the coupler 2 passes through the coupling hole 213 through the anchor head 22 and is inserted into the latch hole 41 of the shell 4; then the bolt 23 is fastened to the longitudinal hole 222 to expand the stem 221 outwards with the inclined latch teeth 221*a* latching on the rim of the latch hole 41 to fasten the coupler 2 to the shell 4. When locking the shell 4 is desired, wedge the second wedge portions 111 and 112 of the lock 1 horizontally in the first wedge portions 211 and 212 of the coupler 2 (referring to FIGS. 11 and 12); turn the rotary disk 131 to a number other than the unlocking number, the notch 132*a* of the actuation member 132 no longer latches and retains the flange 142*a*, the second spring S2 forces the first retainer 14 to move through its return elastic force so that the boss 141 latches on the butting member 151, and the third spring S3 is not compressed and provides a return elastic force to push the second retainer 15 upwards, and the steel ball 16 is pushed by the sloped surface 152 to enter the steel ball passing hole 113 to latch on the latch trough 214 so that the coupler 2 and the lock 1 form a locking condition (referring to FIGS. 13 and 14).

For unlocking, first, turn the rotary disk 131 to the unlocking number (referring to FIGS. 11 and 12); the notch 132*a* of the actuation member 132 latches on the flange 142*a* of the first retainer 14 to move the first retainer 14; the butting member 151 of the second retainer 15 is no longer latched by the boss 141; move the lock 1 sideward, the latch trough 214 also is moved to force the steel ball 16 retracting in the holding trough 153, thus the lock 1 can be moved away from the coupler 2 to finish unlocking operation.

Figure 15:
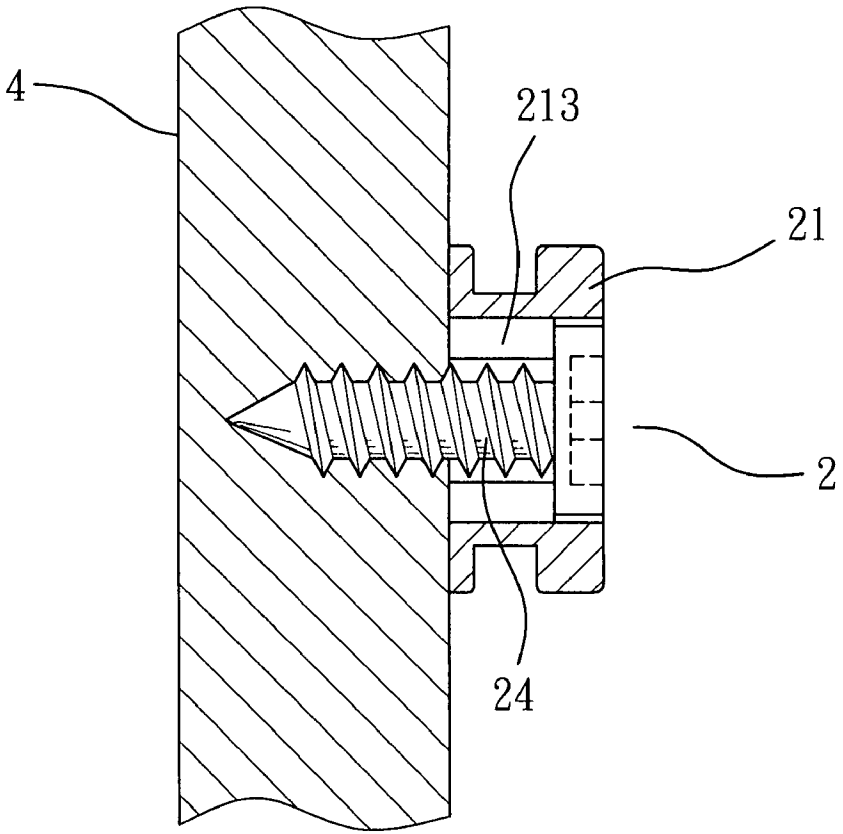
FIG. 15 is a schematic view of another embodiment of the coupler.

Refer to FIG. 15 for another embodiment of the coupler 2. The coupling hole 213 thereof can be fastened by a screw 24 to fasten the body 21 of the coupler 2 to the shell 4.

Figure 16:
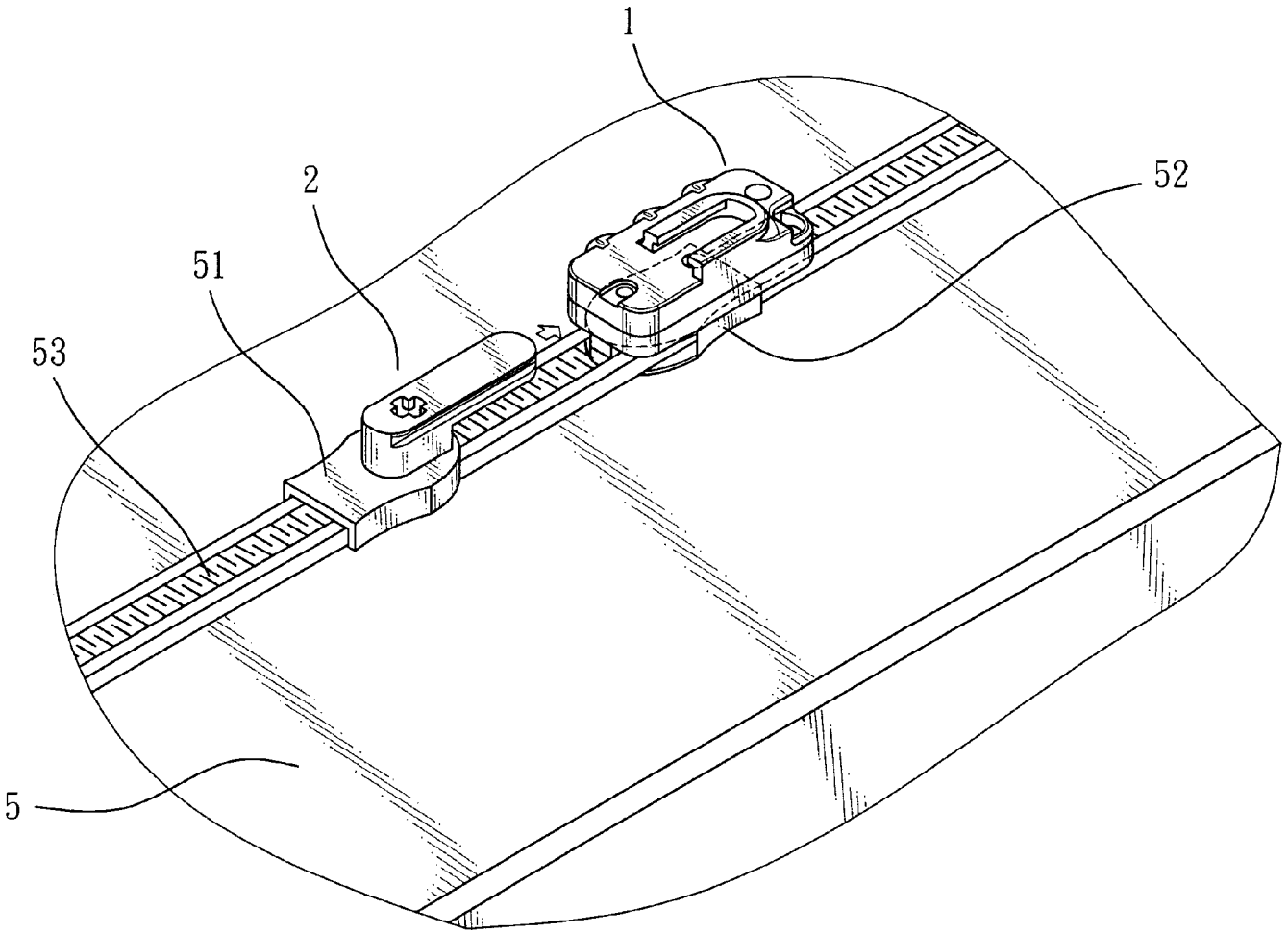
FIG. 16 is a schematic view of an embodiment of the invention.

Refer to FIG. 16 for an embodiment of the invention adopted on a luggage 5. The luggage 5 has a zipper 53 with a first zipper head 51 and a second zipper head 52. The first zipper head 51 can be fastened to the coupler 2 of the invention (that can be integrally formed, or fastened by a fastener or screw), and the second zipper head 52 can be fastened to the lock 1 of the invention. As previously discussed, such a structure also allows horizontal locking and unlocking. The structure of the lock 1 and coupler 2 is same as previously discussed, thus details are omitted herein.

As a conclusion, the invention resolves the problem of the conventional lock jutting outside the shell after the locking that tends to be hit and deformed, and can safely lock a tool kit, repairs box, luggage or the like at a public location, and also provide pilferage prevention effect. It offers a significant improvement over the conventional techniques.

I claim:

1. A horizontal locking case lock comprising:

a coupler fastened to a shell and a lock which has a housing allowing the coupler to wedge and lock on a surface of the lock;

the coupler includes a body which has at least one first wedge portion at one edge and at least one latch trough formed on one side thereof facing the coupler;

the lock includes a left housing and a right housing coupled together to form the housing, the housing including a second wedge portion on the surface thereof latchable by the at least one first wedge portion for locking and a locking mechanism, a first retainer, a second retainer and a steel ball; the first retainer having at least one boss on the top thereof movable by unlocking and locking of the locking mechanism to latch a butting member located at the bottom of the second retainer, the butting member having a sloped surface and a holding trough on an upper side to receive or push the steel ball to pass through a steel ball passing hole formed in the left housing to latch or escape the at least one latch trough of the coupler thereby to actuate unlocking or locking of the coupler and the lock.

2. The horizontal locking case lock of claim 1, wherein the coupler further has a coupling hole at one side to receive an anchor head, the anchor head having a stem at one side which has a plurality of inclined teeth on the surface thereof and a head end at another side, the head end having a longitudinal hole running through the center thereof to divide the stem into at least two portions, the longitudinal hole having an internal thread section near the head end fastenable by a bolt to force the stem to expand outwards to fasten to a latch hole of the shell.

3. The horizontal locking case lock of claim 1, wherein the coupler further has a coupling hole at one side fastenable by a screw to fasten the coupler to the shell.

4. The horizontal locking case lock of claim 1, wherein the butting member of the second retainer has two sides each having a second spring housing trough to hold a third spring.

5. The horizontal locking case lock of claim 1, wherein the first retainer further has a first spring housing trough at one side to hold a second spring.

6. The horizontal locking case lock of claim 1, wherein the locking mechanism includes at least one rotary disk coupled with an actuation member and a first spring and is interposed between an anchor strut located on the left housing and an axle holder formed on the right housing, the at least one rotary disk being selectively positioned in stages by a poking arm.

7. The horizontal locking case lock of claim 1, wherein the housing of the lock has apertures threaded through by a rope to form a connection.

* * * * *